US009358673B2

(12) United States Patent
Overton

(10) Patent No.: US 9,358,673 B2
(45) Date of Patent: Jun. 7, 2016

(54) TOOL PARTICULARLY FOR VALVE REPLACEMENT

(71) Applicant: Harold H. Overton, Escondido, CA (US)

(72) Inventor: Harold H. Overton, Escondido, CA (US)

( * ) Notice: Subject to any disclaimer, the term of this patent is extended or adjusted under 35 U.S.C. 154(b) by 261 days.

(21) Appl. No.: 14/146,525

(22) Filed: Jan. 2, 2014

(65) Prior Publication Data

US 2014/0196579 A1 Jul. 17, 2014

Related U.S. Application Data

(60) Provisional application No. 61/748,302, filed on Jan. 2, 2013.

(51) Int. Cl.

| | |
|---|---|
| ***B25B 27/24*** | (2006.01) |
| ***B25B 13/48*** | (2006.01) |
| ***B25B 7/12*** | (2006.01) |
| ***B25B 13/04*** | (2006.01) |
| ***B25B 13/08*** | (2006.01) |
| ***B25B 23/00*** | (2006.01) |

(52) U.S. Cl.

CPC ..... *B25B 27/24* (2013.01); *B25B 7/123* (2013.01); *B25B 13/04* (2013.01); *B25B 13/08* (2013.01); *B25B 13/48* (2013.01); *B25B 23/0078* (2013.01)

(58) Field of Classification Search

CPC ..... B25B 27/24; B25B 13/48
USPC ..... 81/52, 180.1, 462
See application file for complete search history.

(56) References Cited

U.S. PATENT DOCUMENTS

| | | | | | |
|---|---|---|---|---|---|
| 378,299 | A * | 2/1888 | Finch | B25B 13/488 | 81/57.32 |
| 1,402,391 | A * | 1/1922 | Baldus | B25B 13/48 | 7/128 |
| 1,522,083 | A * | 1/1925 | Stensrud | B21D 11/14 | 72/385 |
| 5,062,326 | A * | 11/1991 | Goldschmidt | B25B 13/5058 | 81/57.32 |
| 5,546,833 | A * | 8/1996 | Holdeman | E21B 19/167 | 81/52 |
| 5,775,183 | A * | 7/1998 | Tavianini | B25B 13/488 | 81/13 |
| 6,931,965 | B1 * | 8/2005 | Fanguy | B25B 13/488 | 81/57.34 |
| 7,181,818 | B1 * | 2/2007 | Qualman | B25B 27/24 | 29/213.1 |
| 7,246,546 | B1 * | 7/2007 | Knoblock | B25B 13/488 | 269/164 |
| 7,628,212 | B2 * | 12/2009 | Tjader | B25B 13/488 | 269/164 |
| 7,874,370 | B2 * | 1/2011 | Tjader | B25B 13/488 | 166/380 |
| 8,191,638 | B2 * | 6/2012 | Tjader | B25B 13/488 | 166/380 |
| 8,342,200 | B1 * | 1/2013 | Payne | B25B 27/00 | 137/15.03 |

* cited by examiner

*Primary Examiner* — David B Thomas
(74) *Attorney, Agent, or Firm* — Lewis Kohn & Walker LLP; Kent M. Walker; Kari Moyer-Henry

(57) ABSTRACT

A tool having segments forming a triangle wherein a connecting bolt segment moves the other two segments together, thus rotating a valve nut, is disclosed. The tool can be attached and easily operated without the disadvantage of having to apply physical strength in an awkward position. Different embodiments are provided that are adaptable to various valve body types.

3 Claims, 9 Drawing Sheets

TOOL PARTICULARLY FOR VALVE REPLACEMENT

PRIORITY CLAIM

This patent application contains subject matter claiming benefit of the priority date of U.S. Prov. Pat. App. Ser. No. 61/748,302 filed on Jan. 2, 2013 and entitled, "POWER TRIANGLE" MECHANISM TO REMOVE ANGLE STOP VALVES; accordingly, the entire contents of this provisional patent application is hereby expressly incorporated by reference.

BACKGROUND OF THE INVENTION

1. Field of the Invention

The present invention generally pertains to devices for loosening threaded hardware, particularly in confined spaces. More specifically in a preferred embodiment, the invention relates to devices for replacing angle stop valves in plumbing systems. Particularly, the present invention is directed to a triangular arrangement of two wrenches having a connecting bar whereby the two wrenches can rotate along the length of the bar to decompress nuts from valve bodies and related method.

2. Description of the Prior Art

Angle stop valves are used under sinks, behind toilets and in a variety of other configurations to connect supply water systems to faucets, refrigerators, water filtration systems, dishwashers and toilets through hoses and/or copper tube connections. In a typical configuration (e.g. FIG. 1), valves are connected to a ½" copper water system using a 15/16" ferrule nut and ferrule ring securing a watertight connection. When first installed, the ferrule nut is placed on the copper pipe and then the ferrule ring is slid onto the pipe. Next the valve is slid onto the copper pipe while the nut is turned to engage with the valve body forcing the ferrule ring into the body of the valve which, in turn, forces the ferrule ring to tighten onto the copper pipe making a secure, watertight fit. To assure this water tight connection the nut is usually tightened very tight. Also as shown in FIG. 1, the valves usually have a spigot handle located on the front of the valve or on top of the valve.

In addition to the tight connection, corrosion can build up between the ferrule nut and the valve and making the nut very difficult to rotate if valve replacement is required. Currently, the method for removing the ferrule nut is to get into a position under a sink so that a worker can get leverage on a wrench and pliers attempting to pull and/or squeeze them together to decompress the nut from the valve body. The danger in the current method is that the act of applying too much pressure to break the corrosive seal may twist the copper pipe causing damage to the pipe and/or actually break it loose from a copper fitting in the wall. Obviously if the copper pipe is damaged and/or if there is damage to the fittings in the wall a relatively small job has just developed into a serious problem. In addition, attempting to work in this position can be detrimental to a workers back.

The problem is even more difficult when replacing a valve in a confined enclosure. Therefore, it is an object of the present invention to apply a measured amount of torque to loosen a valve nut without having a user's arms and hands in awkward positions. It is further an object of the present invention to improve leverage required to decompress a corrosive valve nut.

BRIEF SUMMARY OF THE INVENTION

The present invention specifically addresses and alleviates the above mentioned deficiencies associated with the prior art. More particularly, the present invention in a first aspect, is a tool for rotating a nut adjacent to a valve body comprising: a valve body segment; a ferrule nut segment; and a threaded connecting bolt connecting the valve body segment and the ferrule nut segment approximately at respective distal ends, wherein the valve body has an inlet and an exit port offset by approximately 90 degrees, and wherein the nut is adjacent to the valve body inlet, wherein the valve body segment has a proximal end removably secured to the valve body, wherein the ferrule nut segment has a proximal end removably secured to the nut, and wherein the threaded connecting bolt is rotated in operation of the tool to improve a leverage in applying a torque to the nut.

The invention in this aspect is additional characterized in that the ferrule nut segment further comprises: an aperture approximately at the distal end for receiving the threaded bolt; and a pin whereby the aperture is configured to rotate about the pin, wherein the aperture has an alignment defining an angle between the ferrule nut segment and the connecting bolt, wherein the pin allows for slight adjustment of the angle as the valve body segment and ferrule nut segment move closer together during tool operation.

Still further, the invention in this aspect is characterized wherein the ferrule nut segment further comprises: a slot in a handle portion thereof, the slot configured to receive the connection bolt; and a swivel having an aperture therein, the aperture and slot together configured to receive the connection bolt, wherein the swivel has a curved surface slidingly configured to an edge of the slot wherein thereby the swivel is configured to rotate with respect to the edge of the slot and further wherein thereby the swivel allows for slight adjustment of an angle between the ferrule nut segment and the connecting bolt as the valve body segment and ferrule nut segment move closer together during tool operation.

Yet further, the invention in this aspect is characterized in that the valve body segment further comprises a nut permanently affixed to a side of the valve body segment, the nut for receiving an the threaded connecting bolt, wherein the nut defines a fixed angle between the valve body segment and the threaded connecting bolt. Optionally, the valve body segment secures around the valve body exit port or about the valve stem.

In a second aspect, the invention is characterized as a tool for rotating a nut adjacent to a valve body comprising: a valve body segment; a ferrule nut segment; and a threaded connecting bolt connecting the valve body segment and the ferrule nut segment approximately at respective distal ends, wherein the valve body defines an three dimensional axis (x-y-z), wherein a z axis together with a y-axis together define an inlet and outlet port, respectively, wherein the valve body segment, the ferrule nut segment and connecting bolt lie substantially in an x-y plane, wherein the valve body segment has a proximal end removably secured to the valve body, wherein the ferrule nut segment has a proximal end removably secured to the nut, and wherein the threaded connecting bolt is rotated in operation of the tool to improve a leverage in applying a torque to the nut.

In still a third aspect the invention may be characterized as a system for loosening a nut adjacent to a valve body comprising: a first wrench having a handle portion and a curved head for engaging the nut; a second wrench having a handle portion and an curved head for engaging the valve body; and a connecting bolt configured between the first wrench and the second wrench, wherein the first wrench comprises a slot through the handle portion to receive the connecting bolt.

The invention in this aspect is additionally characterized wherein the system comprises: a rectangular nut housing coupled to the second wrench handle portion for receiving the connecting bolt; and a swivel having an aperture there through further for receiving the connecting bolt, the swivel having a curved surface and interfacing an edge of the slot.

Further the invention is characterized wherein the edge of the slot has a curved surface for interfacing the swivel having a curved surface. Also, the rectangular nut housing is offset by 45 degrees with respect the second wrench handle portion and the connecting bolt so that opposing edges of the housing are aligned to the bolt.

The invention can be better visualized by turning now to the following drawings wherein like elements are referenced by like numerals.

These, as well as other advantages of the present invention will be more apparent from the following description and drawings. It is understood that changes in the specific structure shown and described may be made within the scope of the claims, without departing from the spirit of the invention.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF PREFERRED EMBODIMENTS

Figure 1:
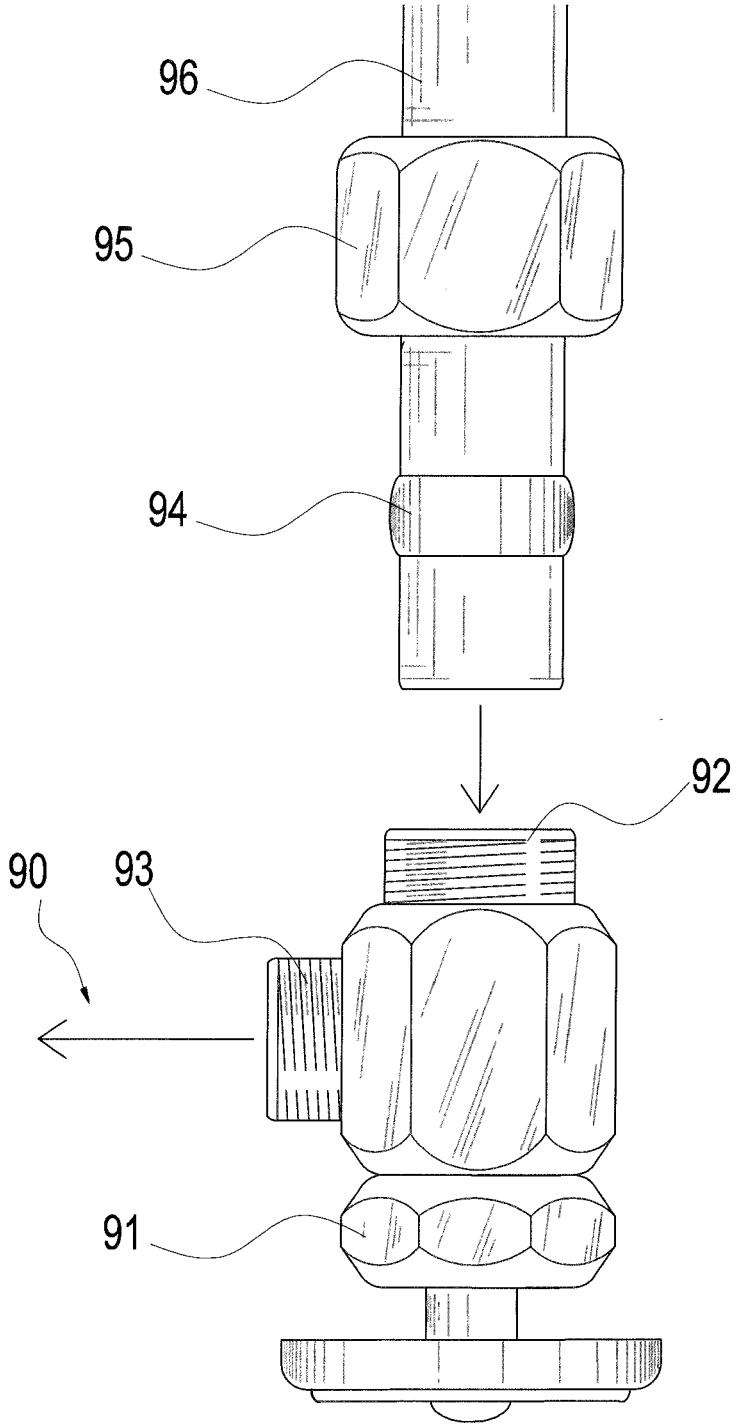
Fig. 1 (Prior Art)
FIG. 1 is illustrative of a prior art angle stop valve with connecting ferrule nut and ring.

As stated herein and regarding FIG. 1, the invention resolves the difficulty of accessing and safely removing an angle stop valve 90 without damaging the copper pipe 96 and/or pipe fittings in a wall. The exemplary valve 90 herein has an inlet 92 and an outlet 93 port. Also as detailed herein, a valve body segment 20, 20*c* of the present invention can either secure around the valve body 91 or around the outlet port 93 (e.g. FIG. 4 or FIG. 7A) The ferrule nut 95 herein is secured to the inlet port 92 and provides a secure watertight connection between the inlet port 92 and the ferrule ring 94.

Figure 2:
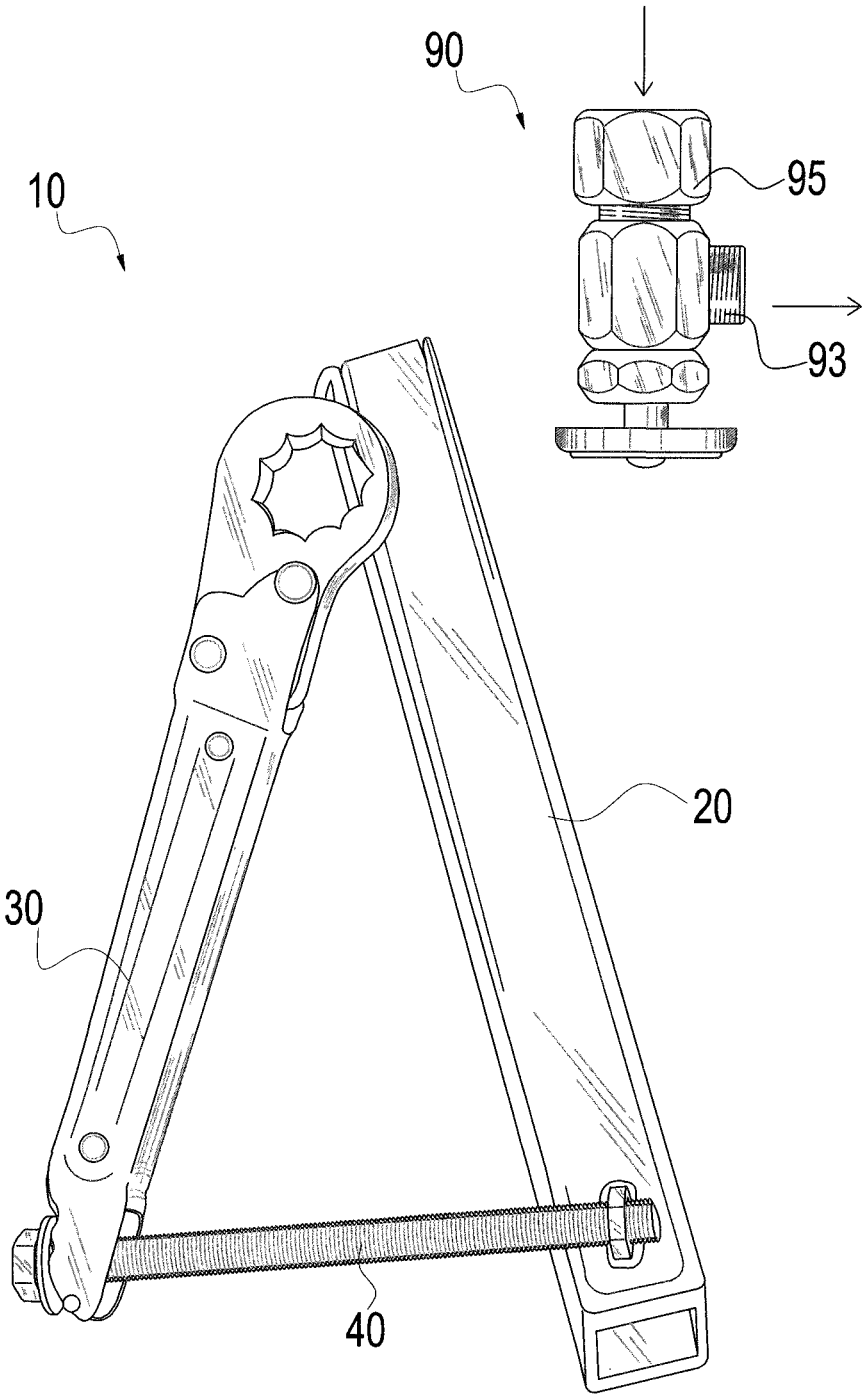
FIG. 2 illustrates a perspective view of a first preferred embodiment adjacent to said valve.
Figure 3:
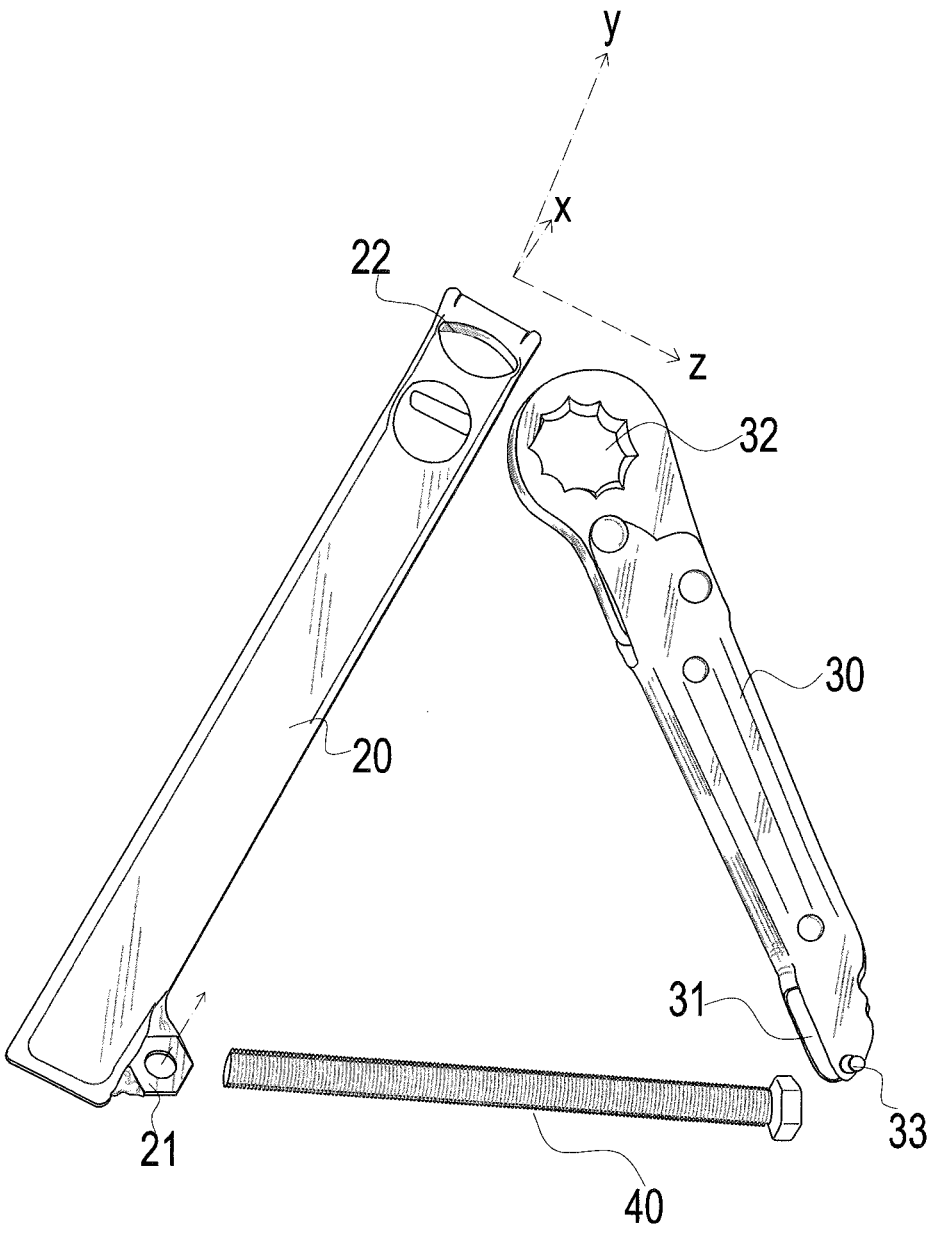
FIG. 3 is an additional illustration of the first preferred embodiment showing individual components.
Figure 4:
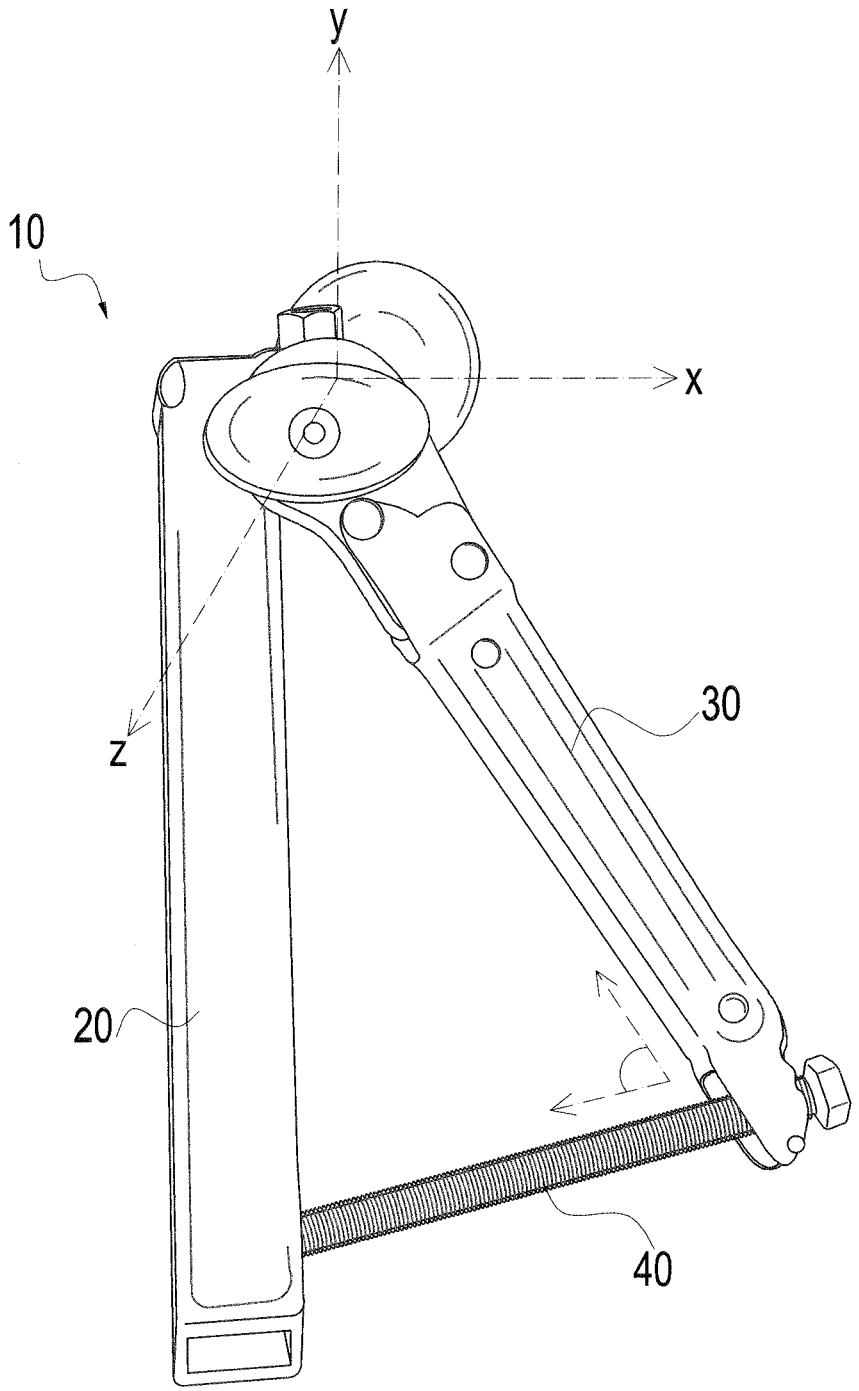
FIG. 4 is a perspective view of the first preferred embodiment in use.

With regard to FIG. 2, FIG. 3 and FIG. 4, axis x-y-z is provided to illustrate the novel alignment herein of the tool 10 and allow for cross referencing between figures. It should be noted that the x-axis in FIG. 3 extends into the page. An important aspect of the invention is that the tool 10, 70 forms a triangle 20, 30, 40 wherein two wrench tools 20, 30 triangle segments have distal ends that are pulled together with a threaded connecting bolt 40. Optionally, a power tool (not shown) could be configured to the threaded connecting bolt 40, or it could be simply hand tightened.

Also referring to FIG. 2, FIG. 3 and FIG. 4, the invention in this embodiment is a tool 10 for rotating a nut 95 adjacent to a valve 90 body that includes a valve body segment 20, a ferrule nut segment 30, and a threaded connecting bolt 40. The bolt 40 further connects the valve body and the ferrule nut segments 20, 30 approximately at respective distal ends. In this example, the valve 90 has an inlet 92 and an exit 93 port offset by approximately 90 degrees, wherein further the exit port is aligned about the y-axis. The valve body segment has a proximal end (such as the working end of a wrench, or spanner) removably secured to the valve body. In the embodiments shown in FIG. 4 and FIG. 7A, the valve body segment either secures about the exit port 93 (y-axis), or about the valve stem 91 (z-axis). Similarly, the ferrule nut segment 30 has a proximal (spanner) end removably secured to the ferrule nut 95.

Figure 7A:
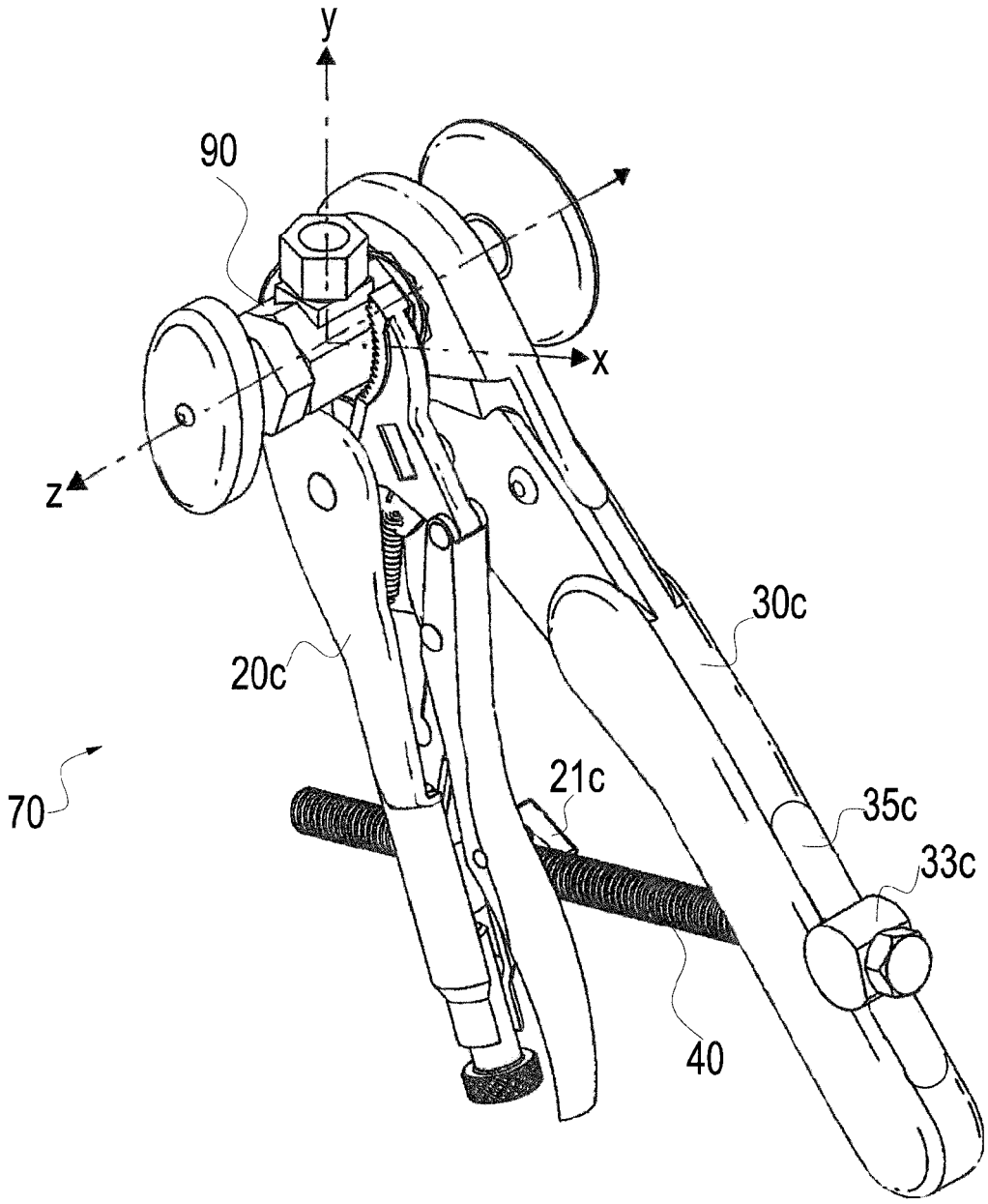
FIG. 7A and FIG. 7B are forward and rear perspective views of a second preferred embodiment of the present invention.

Specifically regarding FIG. 3 and FIG. 4, an important aspect of the invention are the apertures 31 and nuts 21 provided for receiving the threaded connecting bolt. In the preferred embodiment, a nut is wielded to the valve body tool 20 approximately near its distal end. Therefore, the angle formed by the connecting bolt 40 and valve body segment 20 will be fixed throughout the range of motion of the connecting bolt 20. Conversely the aperture 31 that receives the bolt 40 head will have a pivot 33 or swivel 33*c* (FIG. 7A). This configuration allows for small changes in the angle between the ferrule nut segment 30 and the connecting bolt 40 as illustrated in FIG. 4.

As stated, the problem with the prior art devices in the field is that they require a user to get leverage on the ferrule nut 95 with two wrenches usually from a very awkward position (and usually under a sink) and subsequently require physically pulling the two wrenches together decompressing the ferrule nut from the angle stop valve. The triangular mechanism 10 of the present invention can be attached and easily operated from a safe position without the disadvantage of physically climbing into an enclosure, and from an awkward position trying to apply physical strength pulling two wrenches together.

Figure 5A:
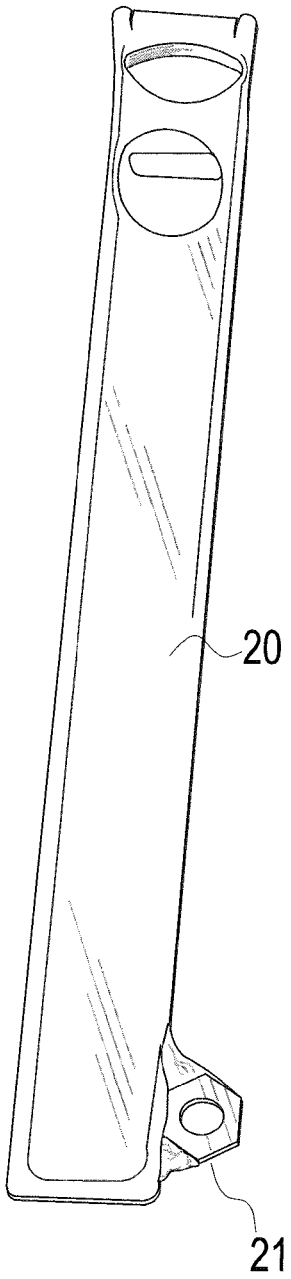
FIG. 5A through FIG. 5C illustrate alternate embodiments for a valve body segment of the present invention.
Figure 5B:
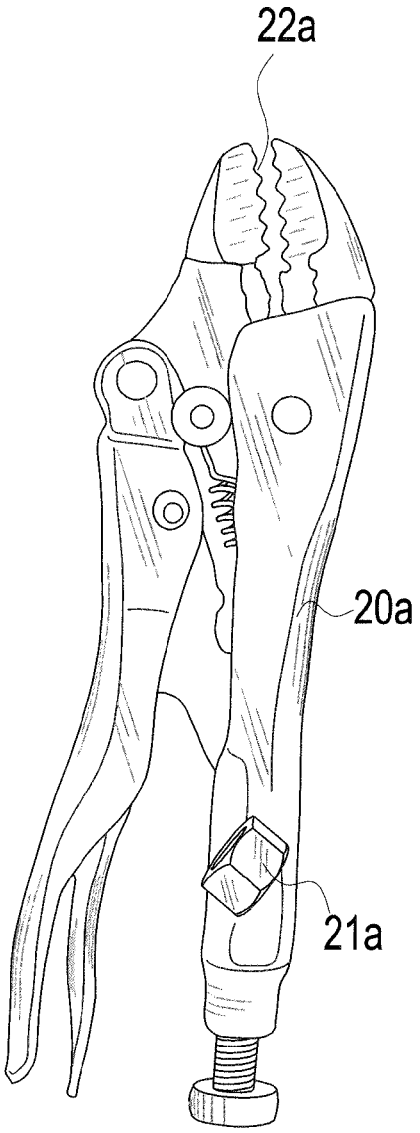
Figure 5C:
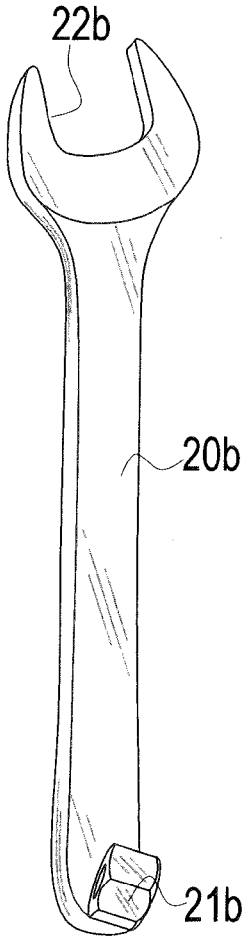

With regard to FIG. 5A, FIG. 5B and FIG. 5C, the valve body may be an open ended wrench (spanner) or closed spanner particularly if the exit line can be removed as illustrated in FIG. 4. Regarding FIG. 5A, a specially designed tool 20 is provided having a steel tube handle. FIG. 5B illustrates a modified squeeze lock 22*a* pliers 20*a* with a fixed nut 21*a* wielded to a side and at an angle thereto. FIG. 5C illustrates and open spanner 22*b* wrench 20*b* (e.g. 11/16") with fixed nut at a distal end 21*b*.

Figure 6A:
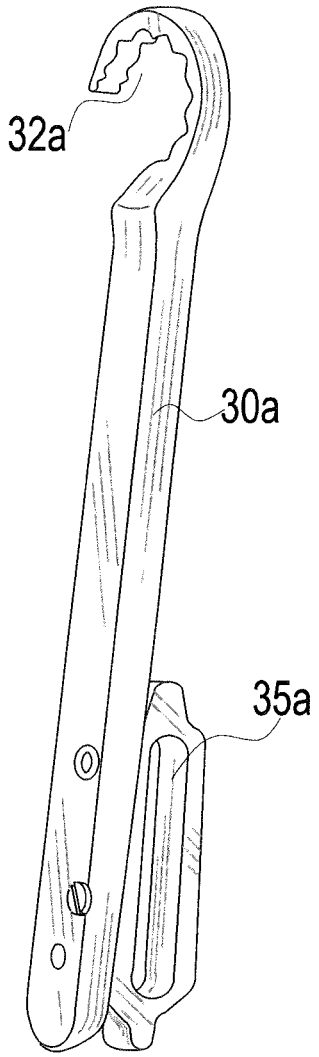
FIG. 6A through FIG. 6C illustrate alternate embodiments for a ferrule nut segment of the present invention.
Figure 6B:
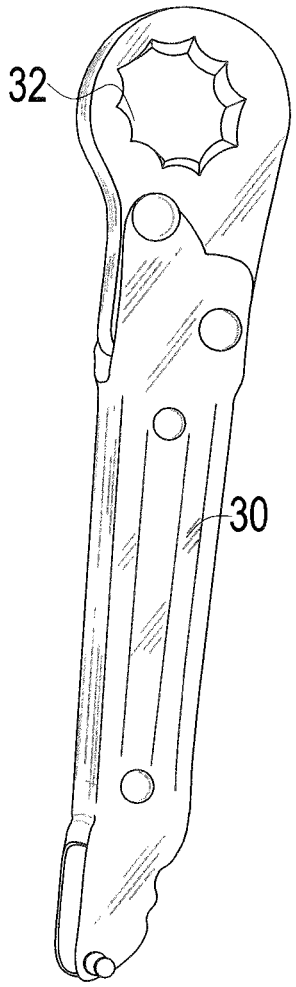
Figure 6C:
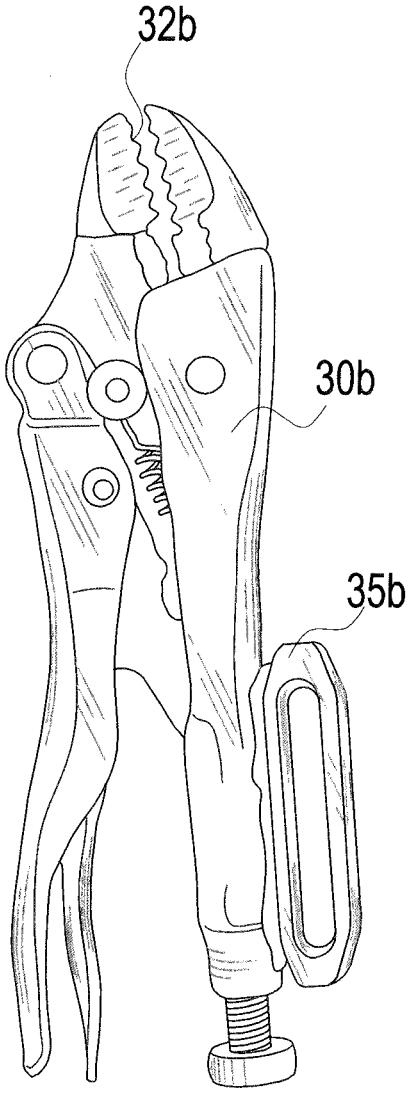

FIG. 6A, FIG. 6B and FIG. 6C are illustrative of ferrule nut segment exemplary embodiments. More particularly, FIG. 6A shows a modified box wrench 30 (e.g. 15/16") with slot 35*a* on a handle portion as detailed further herein. FIG. 6B illustrates a snap lock wrench 30. FIG. 6C shows a modified squeeze lock pliers 30*b* with slot 35*b* on handle.

In another aspect, the invention is a method of making and using a wrench tool. First in the method is the step of manufacturing or assembling a snap lock tool 30 (e.g. 8") that will fit over a nut 95 with a snap lock 32 on a proximal end and a slot 35*c* on a distal end. Next, wield a bolt alignment slot device 21*c* onto the handle of a vise grip 20*c*. Next, manufacture or assemble a box wrench 30*a* (e.g. 8" long, 15/16") with an opening in the box 32*a* to slide over a copper pipe 96 (e.g. 1/2") with a bolt alignment slot device 35*a* at the distal end. Next, manufacture or assemble an open-end 22*b* wrench 20*b* (e.g. 8" long, 11/16") with a nut 21*b* (e.g. 3/8") welded to the opposite end. Next, using a piece (e.g. 9¼" long) of tubing 20 (e.g. steel, square, 1¼") weld a nut 21 (e.g. 3/8") to the side of one end at about an angle of 15 degrees and drill two holes (e.g. 5/8") on the proximal end. Trim off the three sides of the tubing 20 without the holes (e.g., down by 1¼"). This will leave one side with a hole sticking up from the bar (e.g., by approximately 1¼"). Fold this section (e.g. 1¼") over 90 degrees away from the body of the tool 20. Weld a nut 21*a* (⅜") to the handle of a vise grip 20*a*. Lastly in the method is the assembly of the triangular tool 10 and 70 as detailed herein and according to particular application.

With regard to FIG. 7A an additional preferred embodiment 70 is illustrated in perspective. In this aspect the invention may be characterized as a system 70 for loosening a nut 95 adjacent to a valve body 90 comprising: a first wrench 30*c* (triangle segment) having a handle portion and a curved head for engaging the nut; a second wrench 20*c* (ferrule nut segment) having a handle portion and an curved head for engaging the valve body 90; and a connecting bolt 40 configured between the first wrench 30*c* and the second wrench 20*c*, wherein the first wrench comprises a slot 35*c* through the handle portion to receive the connecting bolt 40.

Figure 7B:
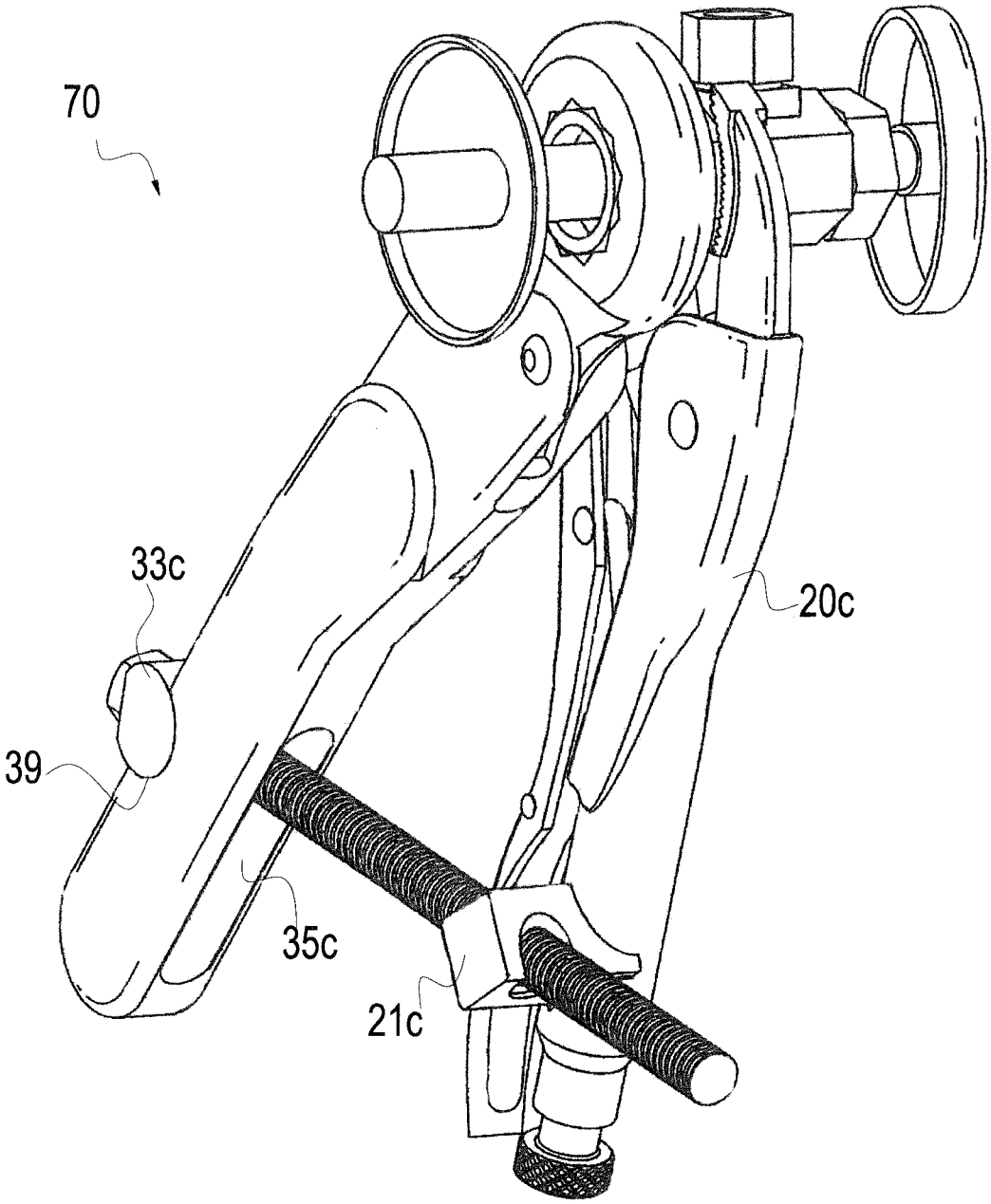
Figure 7C:
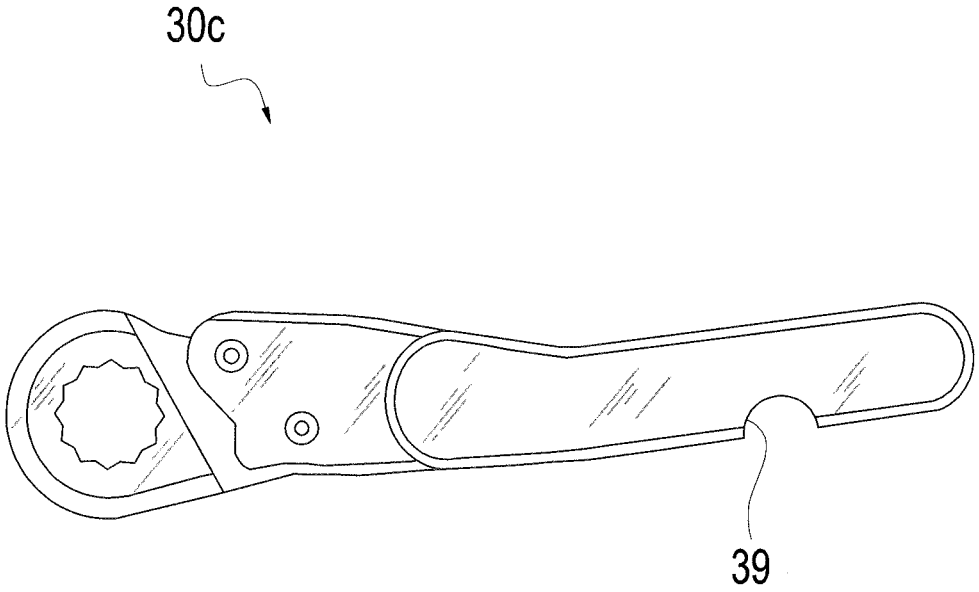
FIG. 7C is a profile view a ferrule nut segment of the embodiment illustrated in FIGS. 7A and 7B.

As best shown in FIG. 7B, a rectangular nut housing 21*c* is provided coupled to the second wrench 20*c* handle portion for receiving the connecting bolt 40. The rectangular nut housing 21*c* is offset by 45 degrees so that the side aspect is diamond shaped and the connecting bolt is received through an aperture in the nut housing. More specifically the aperture is aligned through an edge of nut housing due to the 45 degree offset. The other end of the connecting bolt 40 is received through a swivel 33*c* having an aperture there through. The swivel 33*c* has a curved surface allowing it to rotate for slight adjustments in the angle of the bolt 40 with respect to the first wrench 30*c*. Also as shown in FIG. 7C, the slot may have a curved surface 39 carved out of the slot, for receiving the swivel 33*c*.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

While the particular Tool Particularly for Valve Replacement as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. A tool for rotating a nut adjacent to a valve body comprising:

a valve body segment;

a ferrule nut segment; and a threaded connecting bolt connecting the valve body segment and the ferrule nut segment approximately at respective distal ends, wherein the valve body has an inlet and an exit port offset by approximately 90 degrees, and wherein the nut is adjacent to the valve body inlet, wherein the valve body segment has a proximal end removably secured to the valve body, wherein the ferrule nut segment has a proximal end removably secured to the nut, and wherein the threaded connecting bolt is rotated in operation of the tool to improve a leverage in applying a torque to the nut, the valve body segment further comprising a nut permanently affixed to a side of the valve body segment, the nut for receiving an the threaded connecting bolt, wherein the nut defines a fixed angle between the valve body segment and the threaded connecting bolt.

2. The tool for rotating a nut adjacent to a valve body of claim 1, wherein the valve body segment is secured around the valve body exit port.

3. A system for loosening a nut adjacent to a valve body comprising:

a first wrench having a handle portion and a curved head for engaging the nut;

a second wrench having a handle portion and an curved head for engaging the valve body;

a connecting bolt configured between the first wrench and the second wrench, wherein the first wrench comprises a slot through the handle portion to receive the connecting bolt;

a rectangular nut housing coupled to the second wrench handle portion for receiving the connecting bolt; and a swivel having an aperture there through further for receiving the connecting bolt, the swivel having a curved surface and interfacing an edge of the slot, wherein the rectangular nut housing is offset by 45 degrees with respect the second wrench handle portion and the connecting bolt so that opposing edges of the housing are aligned to the bolt.

* * * * *